US011735096B2

(12) United States Patent
Gao

(10) Patent No.: US 11,735,096 B2
(45) Date of Patent: Aug. 22, 2023

(54) PIXEL DRIVING CIRCUIT INCLUDING CONTROL UNIT TO MEASURE VOLTAGE DIFFERENCE BETWEEN OPPOSITE ENDS OF SAMPLING RESISTOR, AND DISPLAY PANEL INCLUDING THE SAME

(71) Applicant: Shenzhen China Star Optoelectronics Semiconductor Display Technology Co., Ltd., Shenzhen (CN)

(72) Inventor: Lei Gao, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/771,233

(22) PCT Filed: Apr. 15, 2020

(86) PCT No.: PCT/CN2020/084839
§ 371 (c)(1),
(2) Date: Jun. 10, 2020

(87) PCT Pub. No.: WO2021/196288
PCT Pub. Date: Oct. 7, 2021

(65) Prior Publication Data

US 2023/0028085 A1 Jan. 26, 2023

(30) Foreign Application Priority Data

Apr. 2, 2020 (CN) ..... 202010254188.8

(51) Int. Cl.
*G09G 3/32* (2016.01)

(52) U.S. Cl.
CPC ..... *G09G 3/32* (2013.01); *G09G 2300/0842* (2013.01); *G09G 2310/061* (2013.01); *G09G 2320/0252* (2013.01)

(58) Field of Classification Search
CPC ... G09G 3/32–3291; G09G 2300/0809; G09G 2300/0819; G09G 2300/0833;
(Continued)

(56) References Cited

U.S. PATENT DOCUMENTS

2009/0140959 A1 6/2009 Nam et al.
2014/0285407 A1* 9/2014 Chaji ..... G09G 3/3241 345/76

(Continued)

FOREIGN PATENT DOCUMENTS

CN 1875395 A 12/2006
CN 101430862 A 5/2009

(Continued)

OTHER PUBLICATIONS

English translation of CN 105139799 A (Year: 2015).*

*Primary Examiner* — Nathan Danielsen
(74) *Attorney, Agent, or Firm* — Nathan & Associates; Menachem Nathan

(57) ABSTRACT

A pixel driving circuit and a display panel are provided. The pixel driving circuit includes a control unit to output a control signal by detecting a voltage difference between two opposite ends of a sampling resistor, and to turn on a fourth switch by the control signal. When the fourth switch is turned on, a second positive voltage received by the pixel driving circuit charges a second node to further speed up a voltage pulling up of the second node to improve a detecting speed of the pixel driving circuit.

10 Claims, 2 Drawing Sheets

100

$T_3$

(58) Field of Classification Search
CPC ... G09G 2300/0838; G09G 2300/0842; G09G 2300/0871; G09G 2310/0243; G09G 2310/0251; G09G 2310/0264; G09G 2310/0289; G09G 2310/0294; G09G 2310/06; G09G 2310/061; G09G 2310/08; G09G 2320/0223; G09G 2320/0233; G09G 2320/0242; G09G 2320/0252
See application file for complete search history.

(56) References Cited

U.S. PATENT DOCUMENTS

| | | | | |
|---|---|---|---|---|
| 2017/0004764 | A1 | 1/2017 | Kim et al. | |
| 2017/0004769 | A1* | 1/2017 | Nathan | G09G 3/3241 |
| 2017/0061871 | A1* | 3/2017 | Xiang | G09G 3/3233 |
| 2018/0047335 | A1* | 2/2018 | Hwang | G09G 3/3266 |
| 2018/0190192 | A1 | 7/2018 | Kwon et al. | |

FOREIGN PATENT DOCUMENTS

| | | | | |
|---|---|---|---|---|
| CN | 105139799 | A | * | 12/2015 |
| CN | 106328062 | A | | 1/2017 |
| CN | 108109588 | A | | 6/2018 |
| CN | 108269537 | A | | 7/2018 |
| CN | 108877611 | A | | 11/2018 |
| CN | 110136638 | A | | 8/2019 |
| JP | 2012078379 | A | | 4/2012 |
| KR | 20170036569 | A | | 4/2017 |

* cited by examiner

100

$T_3$

PIXEL DRIVING CIRCUIT INCLUDING CONTROL UNIT TO MEASURE VOLTAGE DIFFERENCE BETWEEN OPPOSITE ENDS OF SAMPLING RESISTOR, AND DISPLAY PANEL INCLUDING THE SAME

FIELD

The present disclosure relates to display technologies, and more particularly, to a pixel driving circuit and a display panel.

BACKGROUND

As shown in FIG. 1, a current outside-compensation solution is provide a constant electric potential at a second node s to charge a capacitor by an electric current passing through a driving transistor, and to pull up a electric potential of a first node g. When Vgs is equal to a threshold voltage of the driving transistor, the driving transistor is cut off and has been detected in this way. However, a speed of electric potential pulling up of the second node s is limited by the electric current passing through the driving transistor, and the electric potential of the second node s can not pull up faster.

The current solution is to use iteration to alleviate this situation, but in order to meet accuracy requirements, multiple iterations are required, and improvement effect is not obvious.

In view of this, there is an urgent need for a new solution to quickly increase the electric potential of the second node s.

SUMMARY

In view of the above, the present disclosure provides a pixel driving circuit and a display panel to resolve issues of slow pulling up speed of an electric potential of a second node s of the pixel driving circuit in a storage capacitor charging phase.

In order to achieve above-mentioned object of the present disclosure, one embodiment of the disclosure provides a pixel driving circuit, including a reset unit, a driving unit, a compensating unit, and a control unit. An output end of the reset unit is electrically connected to a first node. A control end of the driving unit is electrically connected to the first node. An output end of the compensating unit is electrically connected to a second node. An output end of the control unit is electrically connected to an input end of the compensating unit. When a second switch in the driving unit is turned on, the control unit measures the second switch in real time, obtains a control signal base on a result of measuring in real time, and sends the control signal to a fourth switch in the control unit to turned on the fourth switch to further pull up an electric potential of the second node.

In one embodiment of the pixel driving circuit of the disclosure, the reset unit further includes a first switch, a gate of the first switch is connected to a scan signal line, a source of the first switch is electrically connected to a data signal line, and a drain of the first switch is electrically connected to the first node.

In one embodiment of the pixel driving circuit of the disclosure, the driving unit includes the second switch, a gate of the second switch is electrically connected to the first node, a source of the second switch is configured to receive a first positive voltage, and a drain of the second switch is electrically connected to the second node.

In one embodiment of the pixel driving circuit of the disclosure, the compensating unit further includes a third switch, a gate of the third switch is connected to a detecting signal line, a source of the third switch is connected to a common voltage signal line, and a drain of the third switch is electrically connected to the second node.

In one embodiment of the pixel driving circuit of the disclosure, the control unit includes a sampling resistor, a differential amplifier, and the fourth switch. A first input end and a second input end of the differential amplifier are electrically connected to two opposite ends of the sampling resistor respectively. A gate of the fourth switch is electrically connected to an output end of the differential amplifier, a source of the fourth switch is configured to receive a second positive voltage, and a drain of the fourth switch is electrically connected to the input end of the compensating unit. The opposite two ends of the sampling resistor are electrically connected to a first positive voltage and an input end of the driving unit respectively.

In one embodiment of the disclosure, the pixel driving circuit further including a storage capacitor, wherein two opposite ends of the storage capacitor are electrically connected to the first node and the second node respectively.

In one embodiment of the disclosure, the pixel driving circuit further including a light emitting diode, wherein an anode of the light emitting diode is electrically connected to the second node, and a cathode of the light emitting diode is electrically connected to a negative voltage.

In one embodiment of the pixel driving circuit of the disclosure, a scan signal line and a detecting signal line are both at a high electric level when the storage capacitor is in a charging phase.

In one embodiment of the pixel driving circuit of the disclosure, the fourth switch is turned off when a voltage of the first node and a voltage of the second node are equal to a threshold voltage of the second switch.

Another embodiment of the disclosure further provides display panel including any one of the abovementioned pixel driving circuits.

In comparison with prior art, the pixel driving circuit provides the control unit to output a control signal by detecting a voltage difference between two opposite ends of a sampling resistor, and to turn on a fourth switch by the control signal. When the fourth switch is turned on, a second positive voltage received by the pixel driving circuit charges a second node to further speed up a voltage pulling up of the second node to improve a detecting speed of the pixel driving circuit.

BRIEF DESCRIPTION OF DRAWINGS

Detailed descriptions of the embodiments of the present application will make the technical solution and other beneficial effects of the present application obvious in the following with reference to drawings

DETAILED DESCRIPTION

Figure 1:
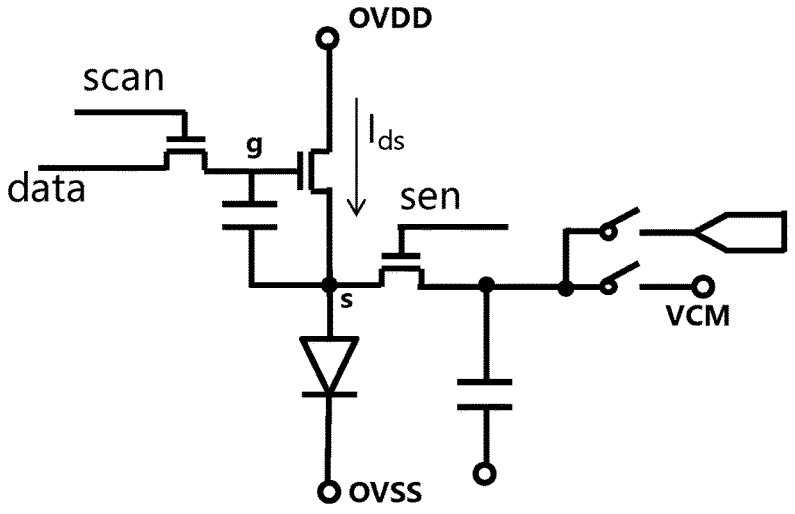
Prior Art FIG. 1
FIG. 1 is a schematic view of structure of a pixel driving circuit according to prior art.

The technical solutions in the embodiments of the present application will be described clearly and completely in conjunction with the drawings in the embodiments of the present application. Obviously, the described embodiments are only a part of the embodiments of the present application, but not all the embodiments. Based on the embodiments in the present application, all other embodiments obtained by those skilled in the art without making creative work fall within the protection scope of the present application.

In the description of this application, it should be understood that the terms "center", "longitudinal", "transverse", "length", "width", "thickness", "upper", "lower", "front", "Back", "Left", "Right", "Vertical", "Horizontal", "Top", "Bottom", "Inner", "Outer", "Clockwise", "Counterclockwise" etc. The positional relationship is based on the orientation or positional relationship shown in the drawings, and is only for the convenience of describing the application and simplifying the description, rather than indicating or implying that the device or element referred to must have a specific orientation, be constructed and operated in a specific orientation, Therefore, it cannot be understood as a limitation to this application. In addition, the terms "first" and "second" are used for description purposes only, and cannot be understood as indicating or implying relative importance or implicitly indicating the number of technical features indicated. Thus, features defined as "first" and "second" may explicitly or implicitly include one or more of the features. In the description of this application, the meaning of "plurality" is two or more, unless otherwise specifically limited.

In the description of this application, it should be noted that, unless otherwise clearly specified and limited, the terms "installation", "connection", and "connection" should be understood in a broad sense, for example, it can be fixed connection or detachable Connected, or integrally connected; may be mechanical, electrical, or may communicate with each other; may be directly connected, or may be indirectly connected through an intermediary, may be the connection between two elements or the interaction of two elements relationship. Those of ordinary skill in the art can understand the specific meanings of the above terms in this application according to specific situations. In this embodiment, the analog display screen touch unit is connected to the head tracking unit, and is used to obtain a movement path of the sensitive cursor in the display device.

In this application, unless otherwise clearly specified and defined, the first feature "above" or "below" the second feature may include the direct contact of the first and second features, or may include the first and second features Contact not directly but through another feature between them. Moreover, the first feature is "above", "over" and "on" the second feature includes that the first feature is directly above and obliquely above the second feature, or simply means that the first feature is higher in level than the second feature. The first feature is "below", "under" and "beneath" the second feature includes that the first feature is directly below and obliquely below the second feature, or simply means that the first feature is less horizontal than the second feature.

The following disclosure provides many different implementations or examples for implementing different structures of the present application. In order to simplify the disclosure of the present application, the components and settings of specific examples are described below. Of course, they are only examples, and the purpose is not to limit this application. In addition, the present application may repeat reference numerals and/or reference letters in different examples. Such repetition is for the purpose of simplicity and clarity, and does not itself indicate the relationship between the various embodiments and/or settings discussed. In addition, the present application provides examples of various specific processes and materials, but those of ordinary skill in the art may be aware of the application of other processes and/or the use of other materials.

Figure 2:
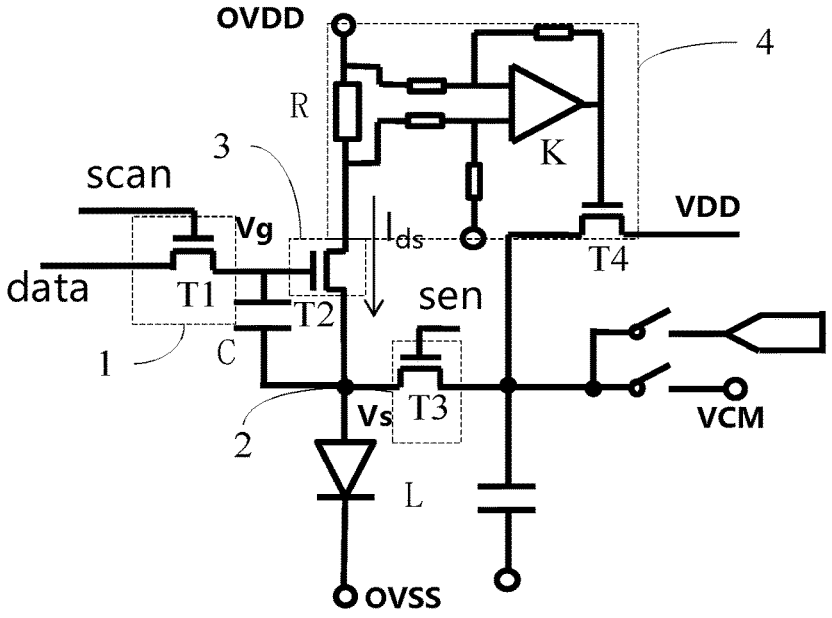
FIG. 2 is a schematic view of a structure of a pixel driving circuit according to an embodiment of the present disclosure.

FIG. 2 is a schematic view of a structure of a pixel driving circuit according to an embodiment of the present disclosure. The pixel driving circuit, includes a reset unit 1, a driving unit 3, a storage capacitor C, a light emitting diode L, a compensating unit 2, and a control unit 4.

An output end of the reset unit 1 is electrically connected to a first node (g). In one embodiment of the pixel driving circuit of the disclosure, the reset unit 1 includes a first switch T1, a gate of the first switch T1 is connected to a scan signal line (scan), a source of the first switch T1 is electrically connected to a data signal line (data), and a drain of the first switch T1 is electrically connected to the first node (g).

A control end of the driving unit 3 is electrically connected to the first node (g). In one embodiment of the pixel driving circuit of the disclosure, the driving unit 3 includes a second switch T2, a gate of the second switch T2 is electrically connected to the first node (g), a source of the second switch T2 is configured to receive a first positive voltage, and a drain of the second switch T2 is electrically connected to a second node (s).

An output end of the compensating unit 2 is electrically connected to the second node (s). In one embodiment of the pixel driving circuit of the disclosure, the compensating unit 2 includes a third switch T3, a gate of the third switch T3 is connected to a detecting signal line (sen), a source of the third switch T3 is connected to a common voltage signal line (VCM), and a drain of the third switch T3 is electrically connected to the second node (s).

An output end of the control unit 4 is electrically connected to an input end of the compensating unit 2. In one embodiment of the pixel driving circuit of the disclosure, the control unit 4 includes a sampling resistor R, a differential amplifier K, and a fourth switch T4. A first input end and a second input end of the differential amplifier K are electrically connected to two opposite ends of the sampling resistor R respectively. A gate of the fourth switch T4 is electrically connected to an output end of the differential amplifier K, a source of the fourth switch T4 is configured to receive a second positive voltage VDD, and a drain of the fourth switch T4 is electrically connected to the input end of the compensating unit 2. The opposite two ends of the sampling resistor R are electrically connected to the first positive voltage OVDD and an input end of the driving unit 3 respectively.

In detail, when a second switch T2 in the driving unit 3 is turned on, a electric current $I_{ds}$ is obtained. The electric current Ids passes through the sampling resistor R and produces electrical potential difference between the opposite two ends of the sampling resistor R. The two input ends of the differential amplifier K are disposed at the opposite two ends of the sampling resistor R. That is, the opposite two ends of the sampling resistor R have the electric potential difference to input to the differential amplifier K. The output end of the differential amplifier is electrically connected to the gate of the fourth switch T4. When the second switch T2 in the driving unit 3 is turned on, the fourth switch T4 is turned on, too. The second positive voltage VDD received by the pixel driving circuit charges the second node (s) to further speed up a voltage pulling up of the second node (s) to improve a detecting speed of the pixel driving circuit.

In one embodiment of the disclosure, two opposite ends of the storage capacitor C are electrically connected to the first node (g) and the second node (s) respectively. The scan signal line (scan) and the detecting signal line (sen) are both at a high electric level when the storage capacitor C is in a charging phase.

In one embodiment of the disclosure, an anode of the light emitting diode L is electrically connected to the second node (s), and a cathode of the light emitting diode L is electrically connected to a negative voltage (ovss).

In comparison with prior art, the pixel driving circuit provides the control unit to output a control signal by detecting a voltage difference between two opposite ends of a sampling resistor, and to turn on a fourth switch by the control signal. When the fourth switch is turned on, a second positive voltage received by the pixel driving circuit charges a second node to further speed up a voltage pulling up of the second node to improve a detecting speed of the pixel driving circuit.

Figure 3:
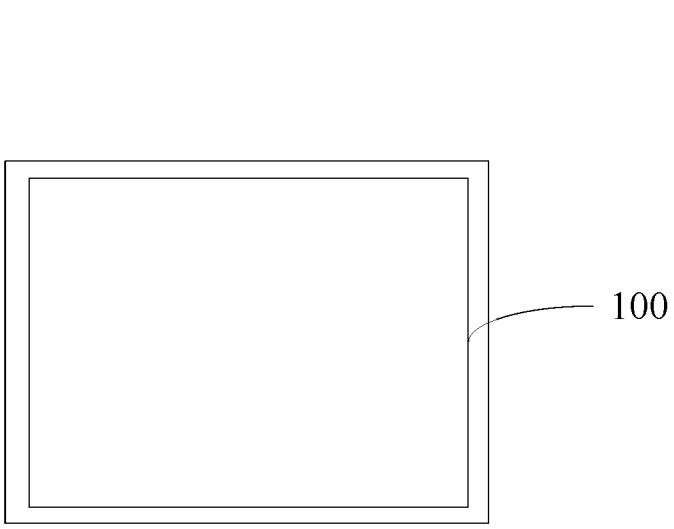
FIG. 3 is a schematic view of a structure of a display panel according to an embodiment of the present disclosure.

As shown in FIG. 3, which is a schematic view of a structure of a display panel according to an embodiment of the present disclosure. another embodiment of the disclosure further provides display panel 200 including any one of the abovementioned pixel driving circuits 100.

The display panel 100 can be applied to a display device. The display device can be: a mobile phone, a tablet computer, a TV, a display, a notebook computer, a digital photo frame, a navigator, and any other products or components with display functions. When the display device adopts the pixel driving circuit 100 described in the above embodiment, its display effect is better.

Of course, the display device of this embodiment may also include other conventional structures, such as a power supply unit and a display driving unit.

In the above embodiments, the description of each embodiment has its own emphasis. For a part that is not detailed in one embodiment, you can refer to related descriptions in other embodiments.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A pixel driving circuit, comprising a reset unit, a driving unit, a compensating unit, and a control unit, wherein an output end of the reset unit is electrically connected to a first node;

a control end of the driving unit is electrically connected to the first node;

an output end of the compensating unit is electrically connected to a second node; and an output end of the control unit is electrically connected to an input end of the compensating unit, when a second switch in the driving unit is turned on, the control unit measures the second switch in real time, obtains a control signal based on a result of measuring in real time, and sends the control signal to a fourth switch in the control unit to turn on the fourth switch to further pull up an electric potential of the second node.

2. The pixel driving circuit according to claim 1, wherein the reset unit further comprises a first switch, a gate of the first switch is connected to a scan signal line, a source of the first switch is electrically connected to a data signal line, and a drain of the first switch is electrically connected to the first node.

3. The pixel driving circuit according to claim 1, wherein the driving unit comprises the second switch, a gate of the second switch is electrically connected to the first node, a source of the second switch is configured to receive a first positive voltage, and a drain of the second switch is electrically connected to the second node.

4. The pixel driving circuit according to claim 1, wherein the compensating unit further comprises a third switch, a gate of the third switch is connected to a detecting signal line, a source of the third switch is connected to a common voltage signal line, and a drain of the third switch is electrically connected to the second node.

5. The pixel driving circuit according to claim 1, wherein the control unit comprises:

a sampling resistor, a differential amplifier, and the fourth switch;

wherein a first input end and a second input end of the differential amplifier are electrically connected to two opposite ends of the sampling resistor respectively;

a gate of the fourth switch is electrically connected to an output end of the differential amplifier, a source of the fourth switch is configured to receive a second positive voltage, and a drain of the fourth switch is electrically connected to the input end of the compensating unit; and the opposite two ends of the sampling resistor are electrically connected to a first positive voltage and an input end of the driving unit respectively.

6. The pixel driving circuit according to claim 1, further comprising a storage capacitor, wherein two opposite ends of the storage capacitor are electrically connected to the first node and the second node respectively.

7. The pixel driving circuit according to claim 6, wherein a scan signal line and a detecting signal line are both at a high electric level when the storage capacitor is in a charging phase.

8. The pixel driving circuit according to claim 1, further comprising a light emitting diode, wherein an anode of the light emitting diode is electrically connected to the second node, and a cathode of the light emitting diode is electrically connected to a negative voltage.

9. The pixel driving circuit according to claim 1, wherein the fourth switch is turned off when a voltage of the first node and a voltage of the second node are equal to a threshold voltage of the second switch.

10. A display panel, comprising the pixel driving circuit according to claim 1.

* * * * *